US008360707B2

(12) United States Patent
Pratt

(10) Patent No.: US 8,360,707 B2
(45) Date of Patent: Jan. 29, 2013

(54) DETACHABLE IMPLEMENT HANDLING APPARATUS FOR TRACTORS

(75) Inventor: Samuel S. Pratt, Bedford, PA (US)

(73) Assignee: Rockland, Inc, Bedford, PA (US)

( * ) Notice: Subject to any disclaimer, the term of this patent is extended or adjusted under 35 U.S.C. 154(b) by 347 days.

(21) Appl. No.: 11/440,119

(22) Filed: May 25, 2006

(65) Prior Publication Data

US 2007/0274816 A1 Nov. 29, 2007

(51) Int. Cl.
*B60P 9/00* (2006.01)

(52) U.S. Cl. ..... 414/680; 212/180; 212/292; 292/106

(58) Field of Classification Search ..... 414/680, 414/724, 918, 542, 543, 462; 293/102, 106, 293/117; 212/180, 292; 172/272, 810; 224/402; 211/17, 21

See application file for complete search history.

(56) References Cited

U.S. PATENT DOCUMENTS

| | | | | |
|---|---|---|---|---|
| 5,211,526 | A * | 5/1993 | Robinette | 414/550 |
| 6,425,727 | B1 * | 7/2002 | Hood | 414/543 |
| 6,830,423 | B1 * | 12/2004 | Williams et al. | 414/462 |
| 2006/0018746 | A1 * | 1/2006 | Gustafson et al. | 414/723 |

* cited by examiner

*Primary Examiner* — Donald Underwood
(74) *Attorney, Agent, or Firm* — Novak Druce + Quigg LLP

(57) ABSTRACT

An apparatus generally consisting of a base member mountable on a component of a prime mover which may be pivoted about a transverse axis, a carrier mounted on the base member displaceable along a transverse line of travel between first and second positions and a boom mounted on the carrier, disposable in an inoperative position disposed along such line of travel when the carrier is in its first position and pivotal to an operative position disposed at an angle relative to such line of travel when the carrier is in its second position.

20 Claims, 2 Drawing Sheets

DETACHABLE IMPLEMENT HANDLING APPARATUS FOR TRACTORS

This invention relates to a detachable implement handling apparatus for tractors and more particularly to such an apparatus which is adapted to be mounted on the push frame of a tractor. The invention further contemplates such an apparatus provided with means for lifting an implement detached therefrom.

BACKGROUND OF THE INVENTION

In the construction industry and other related industries such as the logging industry and the like, it has been a common practice to utilize tractors equipped with various tools to perform a variety of work functions such as clearing, grading, raking, tree shearing, trunk splitting and the like. Typically, such implements are mounted on the front end of a push frame of a tractor which is pivotal about a transverse axis for lifting and lowering a tool mounted thereon. In performing such work functions, it further has been a common practice to mount couplers on such push frames and correspondingly detachably mount different types of implements on such couplers to provide greater versatility and improve productivity. A problem in the use of such a variety of implements detachably connectable to a single coupler is in the handling of such implements when they are detached from a coupler and require to be moved. Such implements are considerably heavy and require mechanically powered means for lifting them off of the ground and loading them onto the bed of a truck. Accordingly, it has been found to be particularly useful to provide an economical and efficient means and method for handling detached implements commonly mountable on the coupler of a tractor and used to perform various work functions in the field.

SUMMARY OF THE INVENTION

The principal object of the present invention is achieved by providing an apparatus generally comprising a base member mountable on a component of a prime mover which may be pivoted about a transverse axis, a carrier mounted on the base member displaceable along a transverse line of travel between first and second positions and a boom mounted on the carrier, disposable in an inoperative position disposed along the line of travel when the carrier is in its first position and pivotal to an operative position disposed at an angle relative to the line of travel when the carrier is in the second position. In the preferred embodiment of the invention, the base member comprises a coupler mountable on the push frame of a tractor, an implement is detachably connectable to the coupler, the coupler is provided with a recess in a front side thereof, the carrier is disposed within such recess and disposable along such line of travel within such recess and such boom includes means for detachably connecting the implement thereto for lifting the implement when detached from the coupler. The boom may consist of a single member or a base section and an extendable section. Such sections further may be telescopically connected together. It further is preferred that means be provided for locking the carrier in the first position with the boom disposed along the line of travel of the carrier, locking the carrier in the second position, locking the boom in the operative position disposed at an angle relative to such line of travel and locking the extendable section of the boom in the extended position relative to the base section in embodiments providing an extendable boom section, particularly in embodiments where the boom comprises base and extendable sections telescopically connected together.

DESCRIPTION OF THE PREFERRED EMBODIMENT OF THE INVENTION

Figure 1:
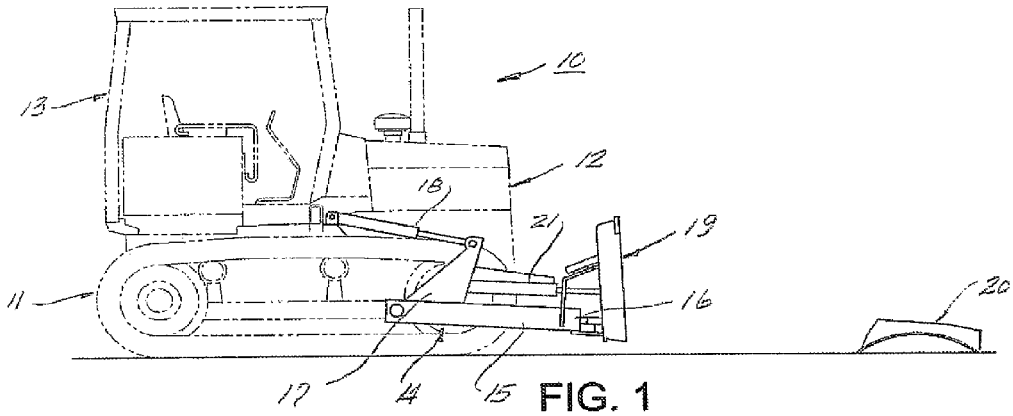
FIG. 1 is a side elevational view of a tractor equipped with a push frame on which a coupler embodying the present invention is mounted, further illustrating an implement having been detached from such coupler, resting on the ground.
Figure 2:
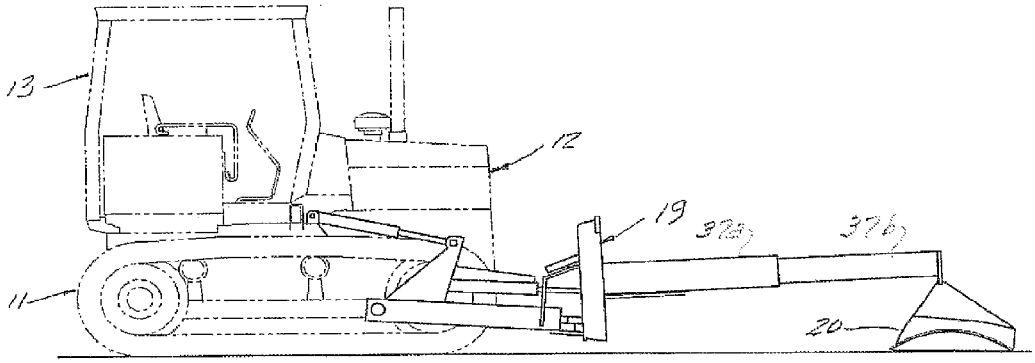
FIG. 2 is a view similar to the view shown in FIG. 1, illustrating the boom of the coupler in an extended, operative condition, with the implement connected to the end thereof by means of a line.
Figure 3:
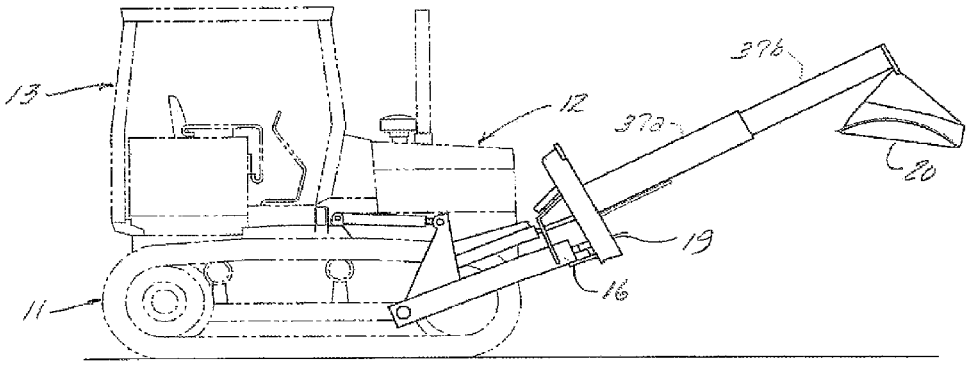
FIG. 3 is a view similar to the view shown in FIGS. 1 and 2, illustrating the implement being lifted by means of pivoting the push frame of the tractor upwardly.
Figure 5:
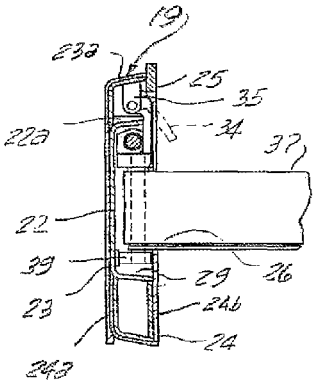
FIG. 5 is a cross-sectional view taken along line 5-5 in FIG. 4, illustrating the carrier in the second position and the boom in the extended, operative position.

Shown in FIGS. 1 through 3 is a crawler tractor 10 which generally includes a lower track assembly 11, an engine 12 mounted on the track assembly and operatively connected to the crawler drives of the track assembly, and a operator's cab 13 supported on the track assembly and provided with controls for operating the tractor. Supported on the track assembly is a push frame 14 having a substantially U-shaped configuration including a pair of transversely spaced sections 15, 15 pivotally connected at rearward ends thereof to the tractor for movement about a transverse axis, and a section 16 disposed transversely, forwardly of the front end of the tractor and interconnecting the forwardly disposed ends of side sections 15, 15. Each of side sections 15, 15 is provided with a bracket 17 on the upper side thereof adjacent the rear end thereof. Interconnecting each of such brackets and a bracket provided on the track assembly of the tractor is a hydraulically actuated cylinder assembly 18. Such assemblies are provided with conventional fluid lines provided with suitable controls to operate the assemblies and correspondingly pivot the push frame upwardly and downwardly in the conventional manner.

Mounted on transverse member 16 is a coupler 19 on which there is adapted to be detachably connected an implement 20. The coupler is connected to the center of the push frame and further is adapted to pivot about an axis substantially perpendicular to the plane of the push frame. A pair of hydraulically actuated cylinder assemblies 21, 21 operatively interconnect side sections 15, 15 of the push frame and coupler 19 so that upon operation of such assemblies the coupler may be angled.

As best seen in FIGS. 5-9, coupler 19 includes a transversely disposed, forwardly opening channel-shaped member 22, a rear panel member 23 secured to the rear side of channel-shaped member 22 and having an upper flange portion 23*a* extending forwardly and spaced from upper flange portion 22*a* of member 22, a channel-shaped member 24 having a rear, upwardly extending flange portion 24*a* secured to the lower end of rear panel member 23 and a forwardly disposed, flange portion 24*b*, a transversely disposed skip member 25 secured to the free end of flange portion 23*a* and spaced from an upper edge of flange portion 24*b* to provide an opening 26, and a pair of side wall members 27 and 28 cooperating with channel-shaped member 22 to provide a compartment 29 opening forwardly.

Figure 4:
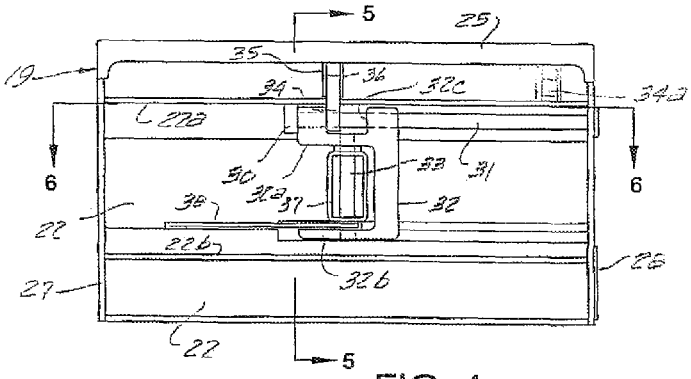
FIG. 4 is an enlarged, front elevational view of the coupler shown in FIGS. 1-3, illustrating the carrier of the boom thereof in a second position and the boom in an extended, operative position.

Depending from flange portion 22*a* of channel-shaped member 22, at a point between end walls 27 and 28, is depending bracket 30. Disposed in the upper end of compartment 26, adjacent flange portion 22*a* is a transversely disposed guide rail 31 supported at its ends on depending bracket 30 and end wall 28. Mounted on rail 31 and displaceable between a first position disposed adjacent end wall 28 and a second position as shown in FIG. 4 is a carriermember 32. As best shown in FIG. 4, carrier member 32 has a substantially C-shaped configuration, reoriented 180 degrees, and is adapted to be displaced between such first and second positions along a line of travel disposed parallel to guide rail 31. Disposed in flange portions 32*a* and 32*b* of the carrier member is a vertically disposed support pin 33. Upper flange portion 32*a* further is notched as at 32*c* for receiving a locking latch 34 when the carrier member, is in the second position as shown in FIG. 4 and a similar locking latch 34*a* when in the first position. Latch 34 is pivotally connected to a pair of brackets 35 and 36 depending from upper flange portion 23*a* of the channel-shaped panel member. The lower end of the carrier member further may be guided on a lower guide rail disposed parallel to upper guide rail 31 and cooperating with the lower end of the carrier member.

Figure 7:
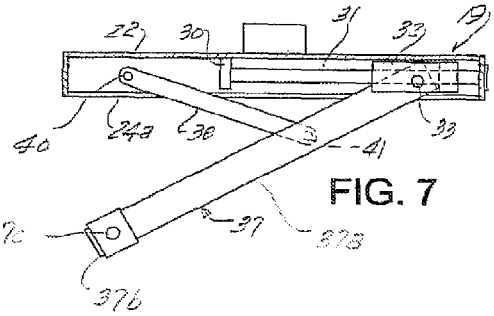
FIG. 7 is a view similar to the view shown in FIG. 6, illustrating the carrier in a sequential position being displaced from its first position to a second position, and the boom in a sequential position being displaced from its retracted, inoperative position to its extended, operative position.
Figure 8:
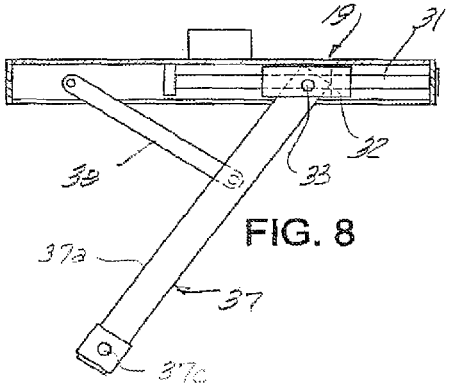
FIG. 8 is a view similar to the view shown in FIG. 7, illustrating a further sequential position of the boom being displaced from its retracted, inoperative position to its extended, operative position.

Pivotally mounted at one end thereof to support pin 33 is a boom 37 having a length and cross-sectional configuration adequate to permit the boom to be received within compartment 29 when carrier 32 is displaced in a first position at one end of the compartment, and further to permit the boom to be pivoted outwardly from compartment 29 thought opening 26 when the carrier is moved from its far end position to its second position in the center of the coupler, in engagement with depending bracket 30. As best shown in FIGS. 1 and 7, a support arm 38 interconnects the coupler and the boom to provide additional transverse support to the boom. Such arm member is pivotally connected at one end to a bracket 39 mounted on channel-shaped member 22 by means of a connecting pin 40, and is pivotally connected to the underside of the boom at a point intermediate the ends thereof by means of a connecting pin 41.

Boom 37 is adapted to be moved between an inoperative position stored within compartment 29 of the coupler and an operative position extending outwardly through opening 26 in the center of the coupler, supported at its rear end on carrier 32 and further supported at its intermediate portion by arm member 38. With the boom in the inoperative position, carrier 32 will be disposed adjacent an end plate of the coupler, locked in place, and boom 37 will be pivoted about support shaft 33 to lie along the line of travel of the carrier. Under such conditions, opening 26 may be closed by a cover panel or closed simply by the mounting of implement 20 on front of the coupler. In the operative position, carrier 32 will be moved to the center of the coupler and secured in such position by latch 34, and boom 37 will be pivoted out through opening 26 about support shaft 33 to a position disposed substantially perpendicular to the front face of the coupler.

In the operative position, the boom is secured to preclude any pivotal movement thereof by means of arm member 38. A line 42 either provided on the free end of boom 37 or independently provided may be used to connect the implement 20 to the free end of the boom in suspended relation.

Figure 6:
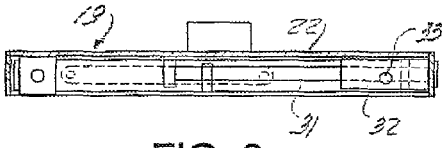
FIG. 6 is a cross-sectional view taken along line 6-6 in FIG. 4, illustrating the carrier in the first position and the boom in the retracted, inoperative position.
Figure 9:
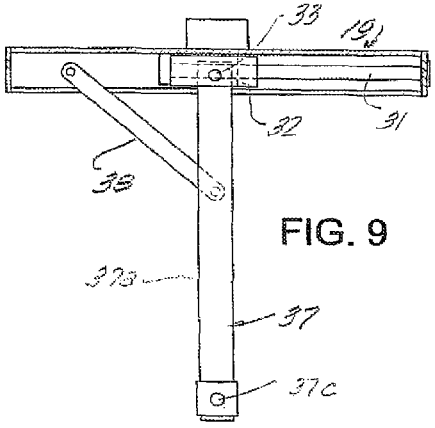
FIG. 9 is a view similar to the view shown in FIG. 8, illustrating the carrier in its second position and the boom in its fully extended, operative position.

FIGS. 6 through 9 illustrate the sequence of positions of boom 37 in moving it between the nested, inoperative position within the coupler as shown in FIG. 6 to the fully extended operative position as shown in FIG. 9. In the retracted inoperative position of the boom, carrier 32 is positioned at the far right end of the coupler, the boom lies transversely within compartment 29 of the coupler and arm member 37 also lies within such compartment under and along the boom. With the implement normally mounted on the front side of the coupler removed, when it is desired to utilize the coupler with the boom to lift the implement resting on the ground, the free end of the boom may be manually gripped and drawn outwardly as shown in FIG. 7, causing arm member 38 to swing outwardly relatively to the coupler, the free end of the boom to pivot outwardly about the axis of connecting pin 41 and the rear end of the boom to pivot about connecting pin 33 as carrier 32 is displaced toward the center of the coupler. As the boom continues to be pivoted outwardly, carrier 32 will engage depending bracket 30, causing the boom and arm member to assume the positions as shown in FIG. 9, with the boom being disposed substantially perpendicularly relative to the transverse line of travel of carrier. With the boom in such operative position, latch 34 is swung downwardly into recess 32*c* of the carrier to lock the carrier in the position as shown in FIGS. 4 and 9. The combination of latch 34 being received in recess 32*c* of the carrier and arm member 38 interconnecting the coupler and the boom, assures the positioning and rigidity of the boom. The tractor can then be maneuvered to position the free end of the boom over the implement resting on the ground, the implement may be attached to the free end of the boom by a cable or chain or any other suitable means and with the implement so attached to the boom, the various controls on the tractor may be utilized to lift the implement, transport it to another location and lower it at such a location such as the bed of a truck used to transport the implement.

With an implement detached from the free end of the boom, it may be retracted from the extended, operative position as shown in FIG. 9 to the retracted, inoperative position as shown in FIG. 6 simply by reversing the procedure as described. Initially, latch 34 would be disengaged, the boom would be pivoted in a clockwise direction about the axis of connecting pin 33 to displace the carrier toward its first position at the end of guide rail and pivot arm member 38 in a counterclockwise direction into the compartment of the coupler. Once the carrier is in its initial, first position adjacent end wall 28 and the boom and arm member are fully rotated into compartment 29, as shown in FIG. 6, suitable means such as a latch similar to latch 34 may be used to lock the carrier in its position to the right to prevent the various components from exiting compartment 29.

Under normal operating conditions for perhaps grading a site, implement 20 will be detachably mounted on the front face of the coupler, and the tractor will be operated in the normal manner to perform conventional grading operations.

During such use of the tractor with implement 20 mounted on the coupler thereof, boom 37 will be securely nested in compartment 29 within the coupler and will not displace to interfere with the work being performed. When it is desired to mount a different implement on the coupler or simply remove the implement at the close of the work being performed, the coupling mechanism on the coupler is manipulated to free the implement from the coupler and permit it to rest on the ground. Cylinder assemblies 18, 18 are operative to lift and lower the suspended implement, and the crawler assemblies of the tractor are operated to transport the implement to the desired site. Small movements of the boom from side to side further may be effected by operation of cylinders 21, 21.

Boom 37 may consist of a single member or may consist of a base member 37*a* and an extendable member 37*b*, telescopically connected together. In such embodiments, the coupler is constructed in the manner as previously described and compartment 29 and opening 26 are formed large enough to accommodate the retracted boom within compartment 29, and permit it to be swung from its inoperative to operative positions through opening 26. In the extended position, the extended section of the boom would be pinned to the base section 37*a* as at 37*c* to provide a rigid boom construction. It is contemplated that an extendable boom construction would employed in applications requiring a longer reach of the boom. It is contemplated that the displacement of the carrier along the guide rail from its storage position to its support position, the movement of the boom from the inoperative to the operative positions and the extension and retraction of any extended section of the boom, be performed manually. However, it further is contemplated that such movements can be effected by powered means such as hydraulic cylinder assemblies. Furthermore, although the invention has been described in terms of handling an implement detached from a coupler mounted on a tractor, it further is within the contemplation of the invention to utilize the boom as described for handling any type of article which it is desired to lift, transport and lower. The coupler and boom may be constructed of conventional steel plate in flat or other configurations. The guide rail may be formed of a steel shaft and the carrier may be formed of either a casting or fabricated steel. Removable pins or other means may be utilized to secure the carrier and the boom or boom sections in their operative and inoperative positions. It further is preferred yet not essential that the boom be confined within the envelope of the coupler. From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus mountable on a front end assembly of a prime mover, pivotal relative to said prime mover about a transverse axis, comprising:

a base member mountable on said assembly;

a carrier disposed within a recess in a front side of said base member, permanently mounted on a guide member disposed on said base member confined within upper and lower ends thereof, displaceable along a transverse line of travel between first and second positions; and a boom mounted on said carrier, pivotal about an axis disposed perpendicular to and in a plane including said line of travel between an inoperative position disposed along said line of travel when said carrier is in said first position and an operative position disposed at an angle to said line of travel when said carrier is in said second position, wherein said base member comprises a coupler and including an implement detachably connectable to said coupler, and said boom includes means for detachably securing said implement thereto for lifting said implement when detached from said coupler.

2. A device according to claim 1 including means for detachably securing said carrier in said first position.

3. An apparatus according to claim 1 wherein said first position of said carrier is disposed at an end of said line of travel.

4. An apparatus according to claim 3 including means for detachably securing said carrier in said first position.

5. An apparatus according to claim 1 including means for detachably securing said carrier in said second position.

6. An apparatus according to claim 1 wherein said second position of said carrier is disposed at a location intermediate the ends of said base member.

7. An apparatus according to claim 6 including means for detachably securing said carrier in said second position.

8. An apparatus according to claim 1 wherein said boom is pivotal to an angle substantially perpendicular to said line of travel when said carrier is in said second position.

9. An apparatus according to claim 8 wherein said second position is disposed at a center of said base member.

10. An apparatus according to claim 1 wherein said boom includes a base section and an extendable section retractable relative to said base section when said carrier is in said first position and said boom is disposed along said line of travel.

11. An apparatus according to claim 10 including means for detachably securing said extendable section in an extended condition relative to said base section.

12. An apparatus according to claim 10 wherein said base and extendable sections are telescopically connected.

13. An apparatus according to claim 12 including means for detachably securing said extendable section in an extended condition relative to said base section.

14. An apparatus according to claim 1 including means provided on said boom detachably connectable to an article to be lifted by pivotal movement of said front end assembly of said prime mover.

15. An apparatus according to claim 1 wherein said implement is mountable on said coupler to cover said recess.

16. An apparatus according to claim 1 wherein said recess is sufficiently spacious to receive said boom when said carrier is in said first position and said boom is disposed in an inoperative position along said line of travel.

17. An apparatus according to claim 1 wherein said means for detachably securing said implement to said boom includes a line for suspending said implement from said boom.

18. An apparatus according to claim 1 wherein said component of said prime mover comprises a push frame of a tractor.

19. An apparatus according to claim 1 including guide means disposed along said line of travel and wherein said carrier is displaceable along said guide means.

20. An apparatus according to claim 1 including a support arm pivotally connected at one end thereof to said base member and pivotally connected at another end thereof to said boom.

* * * * *